US009441605B2

(12) United States Patent
Schremmer

(10) Patent No.: US 9,441,605 B2
(45) Date of Patent: Sep. 13, 2016

(54) CORONA IGNITION SYSTEM AND METHOD FOR CONTROLLING A CORONA IGNITION DEVICE

(71) Applicant: BorgWarner Ludwigsburg GmbH, Ludwigsburg (DE)

(72) Inventor: Torsten Schremmer, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 156 days.

(21) Appl. No.: 14/453,208

(22) Filed: Aug. 6, 2014

(65) Prior Publication Data

US 2015/0040850 A1 Feb. 12, 2015

(30) Foreign Application Priority Data

Aug. 12, 2013 (DE) ..... 10 2013 108 705

(51) Int. Cl.

| | |
|---|---|
| ***F02P 3/01*** | (2006.01) |
| ***F02P 9/00*** | (2006.01) |
| ***F02P 23/04*** | (2006.01) |
| *H01T 19/02* | (2006.01) |
| *H01T 19/00* | (2006.01) |

(Continued)

(52) U.S. Cl.

CPC ..... *F02P 9/002* (2013.01); *F02P 23/04* (2013.01); *F02P 23/045* (2013.01); *F02D 2041/2051* (2013.01); *F02P 9/007* (2013.01); *H01T 19/00* (2013.01); *H01T 19/02* (2013.01); *H01T 19/04* (2013.01)

(58) Field of Classification Search

CPC ..... F02P 9/002; F02P 23/04; F02P 23/045; F02P 9/007; F02D 2041/2051; H01T 19/00; H01T 19/02; H01T 19/04

USPC .... 123/143 R, 143 B, 143 A, 606, 608, 162, 123/536; 701/102, 113; 324/600, 633, 678

See application file for complete search history.

(56) References Cited

U.S. PATENT DOCUMENTS

| | | | | |
|---|---|---|---|---|
| 3,800,179 A * | 3/1974 | Louzecky | ..... | H01T 13/14 123/169 CL |
| 4,317,068 A * | 2/1982 | Ward | ..... | H01T 13/50 123/169 MG |
| 4,787,360 A * | 11/1988 | Filippone | ..... | F02P 3/01 123/406.66 |

(Continued)

FOREIGN PATENT DOCUMENTS

| | | |
|---|---|---|
| DE | 10 2011 052 096 A1 | 3/2012 |
| DE | 10 2012 104 642 A1 | 12/2013 |
| WO | WO 2010/011838 A1 | 1/2010 |

*Primary Examiner* — Joseph Dallo

(74) *Attorney, Agent, or Firm* — Bose McKinney & Evans LLP

(57) ABSTRACT

A corona ignition system that can be operated with relatively low expenditure in the vicinity of its resonant frequency. For each ignition, impedance and frequency values are stored in a data structure and are allocated to a respective voltage value. The data structure is complemented by an adjustment variable whose value specifies whether the present frequency value of the present engine cycle has been classified as too high or too low. The value of the adjustment variable is determined anew in each engine cycle. To that end, a comparison is made between a present frequency value with an earlier frequency value and a present impedance value with an earlier impedance value. Based upon the comparison, a value can be assigned to the adjustment value to cause a lower or higher frequency value of the corona discharge in the next cycle.

11 Claims, 3 Drawing Sheets

(51) Int. Cl.
*F02D 41/20* (2006.01)
*H01T 19/04* (2006.01)

(56) References Cited

U.S. PATENT DOCUMENTS 5,793,151 A * 8/1998 Kagawa ..... H01T 13/52 313/130
5,941,208 A * 8/1999 Biemelt ..... F02D 41/3029 123/169 CL
6,035,838 A * 3/2000 Tozzi ..... F02P 3/053 123/618
6,752,122 B2 * 6/2004 Yuya ..... F02D 41/2403 123/295
7,038,482 B1 * 5/2006 Bi ..... G01R 31/2621 324/762.09
7,825,666 B2 * 11/2010 Hashimoto ..... G01R 31/31721 324/522
8,746,218 B2 * 6/2014 Freen ..... F02P 17/12 123/143 B
2001/0017125 A1 * 8/2001 Matsubara ..... F02P 9/007 123/310
2004/0112350 A1 * 6/2004 Schleupen ..... H03F 3/601 123/606
2004/0129241 A1 * 7/2004 Freen ..... F02C 7/266 123/143 B
2009/0165763 A1 * 7/2009 Heuermann ..... F02P 23/045 123/606
2010/0282198 A1 11/2010 Hampton et al.
2011/0114071 A1 * 5/2011 Freen ..... F02P 23/04 123/623
2011/0144071 A1 * 6/2011 Grawe ..... A61K 9/1652 514/173
2011/0253114 A1 * 10/2011 Schremmer ..... F02P 23/04 123/606
2011/0297132 A1 * 12/2011 Schremmer ..... F02P 23/04 123/598
2011/0305998 A1 * 12/2011 Toedter ..... F02P 3/01 431/2
2012/0055455 A1 3/2012 Ruan et al.
2013/0319384 A1 12/2013 Trump et al.

* cited by examiner

| Voltage interval | 1 | 2 | 3 | 4 | 5 | 6 | 7 | 8 | ... | n |
|---|---|---|---|---|---|---|---|---|---|---|
| Impedance value | $z_1$ | $z_2$ | $z_3$ | $z_4$ | $z_5$ | $z_6$ | $z_7$ | $z_8$ | ... | $z_n$ |
| Frequency value | $f_1$ | $f_2$ | $f_3$ | $f_4$ | $f_5$ | $f_6$ | $f_7$ | $f_8$ | ... | $f_n$ |

Fig.3

CORONA IGNITION SYSTEM AND METHOD FOR CONTROLLING A CORONA IGNITION DEVICE

RELATED APPLICATIONS

This application claims priority to DE 10 2013 108 705.1, filed Aug. 12, 2013, which is hereby incorporated herein by reference in its entirety.

BACKGROUND

The invention is based on a corona ignition system for the ignition of fuel in a combustion chamber of a cyclically operating internal combustion engine, as is known from WO 2010/011838 A1.

WO 2010/011838 A1 discloses a corona ignition system with which a fuel-air mixture in a combustion chamber of an internal combustion engine can be ignited by a corona discharge generated in the combustion chamber. This corona ignition device has an ignition electrode that is held in an insulator. The ignition electrode forms, together with the insulator and a sheath enclosing the insulator, an electrical capacitance. This capacitance is part of an electrical oscillating circuit of the corona ignition device, which undergoes excitation with a high-frequency alternating voltage, from, for example, 30 kHz to 5 MHz. This leads to a voltage excess at the ignition electrode causing a corona discharge.

Thus, a high-frequency corona discharge can be generated in the combustion chamber. The corona discharge should not turn into an arc discharge or a spark discharge. Therefore, it is ensured that the voltage between the ignition electrode and the ground remains below the breakdown voltage.

WO 2010/011838 A1 discloses that the frequency of the oscillating circuit is regulated measuring the phase shift between current and voltage at the feeder points of the oscillating circuit and regulating the phase shift to zero by means of a phase control loop, since, in a series oscillating circuit, power and voltage are in phase in resonance (phase shift=zero). The phase control loop controls the switching frequency of a switching device, with which a predetermined voltage is applied alternatingly to one primary winding and to the other primary winding of the transformer, such that current and voltage are in phase with each other on the secondary side of the transformer at the feeder points of the series oscillating circuit.

In prior art, the shift of the resonant frequency of the high-frequency oscillating circuit, which contains the high-frequency igniter, is a significant problem. There are various causes of this. One cause for the shift of the resonant frequency is changes in the combustion chamber of the internal combustion engine, for example changes of the temperature, the pressure, the moisture level, the tip or tips of the ignition electrode of the high-frequency igniter becoming dirty, and changes of further parameters that are dependent on the operation of the combustion engine. Also, the fact of corona formation may shift the resonant frequency. Updating the excitation frequency to the resonant frequency by a phase control loop, as is disclosed in WO 2010/011838 A1, is expensive, and only partially solves the problem. The phase control is susceptible to a temperature drift of the components of the phase control loop and to voltage noise.

In order to avoid the disadvantages of a phase control loop, it is known from DE 10 2011 052 096 A1 to monitor the instantaneous values of current or voltage of the oscillating circuit and to excite the high-frequency generator with primary voltage pulses, which are each begun or terminated when the instantaneous value of power or voltage exceeds or falls below a predetermined switching threshold. This method has the disadvantage of requiring sophisticated measuring technology.

SUMMARY

This disclosure demonstrates a way in which a corona ignition device can be operated with relatively low expenditure in the vicinity of its resonant frequency.

According to this disclosure, an impedance value and a frequency value are stored for each ignition in a data structure, for example a field or a table. Each impedance value and each frequency value is allocated to one of several successive voltage intervals in this data structure, namely the voltage interval which contains a voltage value determined for the relevant ignition.

These voltage values can be values of the secondary voltage generated by the high-frequency generator. Then, in the data structure, a respective impedance value and frequency value can be allocated to each of a series of intervals of the secondary voltage. However, in the data structure, it is also possible for impedance and frequency values to be allocated to intervals of the primary voltage.

The data structure is complemented by a variable, the value of which specifies whether the present frequency value of the present engine cycle has been classified as too high or too low. In the following this variable may be called the adjustment variable. For the next corona discharge in the subsequent engine cycle, a higher or lower frequency is then adjusted according to the value of the adjustment variable. The value of the adjustment variable is determined anew in each engine cycle. To that end, a comparison is made between a present frequency value with an earlier frequency value and a present impedance value with an earlier impedance value. The earlier frequency value and the earlier impedance value are read from the data structure. The impedance value and frequency value that are read from the data structure are the values that are allocated to the voltage interval in which the present voltage value is located.

If the present frequency value is higher than the previous frequency value that was stored for the relevant voltage interval and the present impedance value is higher than the previous impedance value that was stored for this voltage interval, a value is assigned to the adjustment variable, which causes a lower frequency value than the present frequency value during the next corona discharge in the subsequent engine cycle.

If the present frequency value is lower than the previous frequency value that was stored for the relevant voltage interval and the present impedance value is lower than the previous impedance value that was stored for this voltage interval, a value is assigned to the adjustment variable, which causes a lower frequency value than the present frequency value during the next corona discharge in the subsequent engine cycle.

If the present frequency value is lower than the previous frequency value that was stored for the relevant voltage interval and the present impedance value is higher than the previous impedance value that was stored for this voltage interval, a value is assigned to the adjustment variable, which causes a higher frequency value than the present frequency value during the next corona discharge in the subsequent engine cycle.

If the present frequency value is higher than the previous frequency value that was stored for the relevant voltage interval and the present impedance value is lower than the previous impedance value that was stored for this voltage interval, a value is assigned to the adjustment variable, which causes a higher frequency value than the present frequency value during the next corona discharge in the subsequent engine cycle.

Then, using the value of the adjustment variable, a new frequency value is calculated from the present frequency value and the value of the adjustment variable, and the high-frequency generator in the next engine cycle is controlled in such a way that it generates an alternating voltage with a frequency corresponding to the new frequency value as the secondary voltage.

After the comparison of the frequency and impedance values with prior values, the present frequency value and the present impedance value are stored in the data structure and thus are allocated to the voltage interval in which the present voltage value is located. By storing the present impedance and frequency values, old values may be overwritten. During the very first start-up, there are no values of earlier ignitions available. Empirical frequency and impedance values, for example, may be stored by the manufacturer in the data structure, which are later overwritten.

The adjustment variable, with whose value the control unit determines the change in a frequency of the alternating voltage for an engine cycle, can be a flag. In this case, the adjustment variable only has two possible values. Then the frequency that is presently to be adjusted differs from the frequency of the preceding engine cycle by a fixed value that has been added to the earlier frequency or subtracted from it according to the value of the flag. This fixed value can be defined as a fraction of the earlier frequency, for example 1%, or can be constant for all frequencies, fixedly predetermined as an absolute value, for example in kHz.

However, the adjustment variable may also have a larger range of values, for example in order to carry out a frequency adjustment in variable steps, the size of which is dependent on how much the present impedance value differs from the earlier impedance value and how much the present frequency value differs from the earlier frequency value.

In one embodiment of this disclosure, each possible value of the adjustment variable causes a change in frequency, such that the frequency value that is presently set always differs from the frequency of the preceding engine cycle. In this way, the control method can be implemented with a low level of expenditure. If, in a comparison of the impedance and frequency values with prior values, an agreement is determined, the value of the adjustment variable can be determined at random or, in this rare incidence, the adjustment variable may always be assigned a value which causes an increase in frequency or a value which causes a decrease in frequency or a value which reverses the previous direction of change.

Between the beginning of a corona discharge and the ignition of fuel in the combustion chamber of an engine changes in the primary voltage and thus also the secondary voltage may occur. Any fluctuations in the primary voltage occurring while a corona discharge is maintained are generally low. The voltage value that is required for the method according to this disclosure can therefore be determined simply by a single measurement. It is also possible to determine the voltage value as an average of several measured values.

Likewise, the impedance may change while a corona discharge is maintained. In order to minimise corresponding influences on the frequency adaptation, the impedance values may, for example, be determined as average values. These can be averaged over the entire duration of a corona discharge or over a defined part of the duration of a corona discharge. For example, the period of time from the beginning of the corona discharge to the ignition of the fuel can be divided into several parts, in particular parts of the same length, and then an average value of the impedance over the middle parts can be calculated. That is to say that in the calculation of the average both end parts may be ignored. Another possibility is to determine the impedance values as maximum or minimum values during the firing period of the corona discharge or during a specific part of the duration of the corona discharge period.

The number of voltage intervals to which impedance and frequency values are allocated in the data structure can for the most part be selected freely. For example, the data structure can provide 64 or more voltage intervals. Impedance and frequency values may be allocated to at least 128 voltage intervals in the data structure, for example to 256 or more voltage intervals.

One advantageous refinement of this disclosure provides that the number of possible changes to the frequency in the same direction without an interim change in the opposite direction is limited. If, therefore, the maximum permissible number of changes in the same direction has been undertaken with respect to the frequency, the frequency is altered to the opposite direction during the next change. If the maximum permissible number is, for example, 10, the frequency after ten increases without a reduction in between shall be reduced during the eleventh change. In this way, the risk of the frequency drifting away as a consequence of measurement errors can be reduced.

For example, the control unit can have a counter that is reset each time the direction of the frequency alteration changes, so a frequency reduction follows a frequency increase or a frequency increase follows a frequency reduction. If the direction of the frequency alteration remains the same, the counter is assigned a higher number. The control unit of the corona ignition system can, for example, change the counter status every time a value is assigned to the adjustment variable with which the frequency value is calculated. For example, the control unit can then, by comparing the present value of the adjustment variable with the (still) stored value, determine whether the counter is to be increased or reset.

If the counter status reaches a predetermined maximum value, a reversal of the direction of change is forced, for example by a value being assigned to the adjustment variable independently of the result of the comparison between current and previous impedance and frequency values, said value having a change in direction as a consequence such that there is a frequency increase after preceding frequency reductions or a frequency reduction after preceding frequency increases. One possibility for this is, after the assignation of a value to the adjustment variable as a consequence of a comparison between the current impedance value and the previous impedance value and between the current frequency value and the previous frequency value, to carry out a new assignation of a value to the adjustment variable before the value of the adjustment variable is used for a frequency calculation. Another possibility is, when the maximum admissible counter status is reached, to dispense with a comparison between the present and prior impedance and frequency values and to assign a value directly to the adjustment variable, said value effecting a reversal of the change in direction.

The description above relates to a counter that counts up from zero to its end value. A counter can be used just as well, which counts down from a starting value to an end value.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 3 is an example for a data structure for controlling the corona ignition device.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
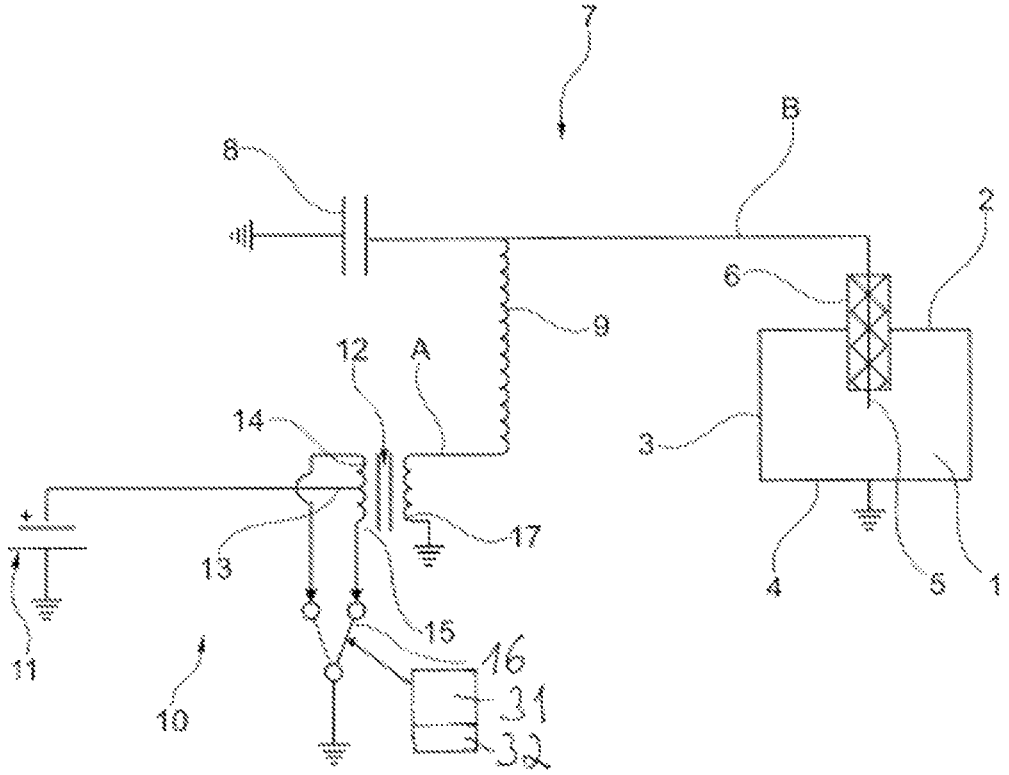
FIG. 1 is a schematic depiction of an example of a corona ignition device.

FIG. 1 shows a combustion chamber 1, which is bordered by walls 2, 3 and 4, which are grounded. An ignition electrode 5 protrudes into the combustion chamber 1 from above. The ignition electrode 5 is enclosed by an insulator 6 on part of its length. The ignition electrode 5 is guided with electrical insulation provided by the insulator 6 through the upper wall 2 into the combustion chamber 1. The ignition electrode 5 and the walls 2 to 4 of the combustion chamber 1 are components of a series oscillating circuit 7 comprising a capacitance 8 and an inductance 9. The series oscillating circuit 7 may of course also comprise further inductances and/or capacitances and other components that are known to the person skilled in the art as potential components for series oscillating circuits.

For the excitation of the oscillating circuit 7, a high-frequency generator 10 is provided, which has a direct current voltage source 11 and a transformer 12 with a center tap 13 on its primary side, whereby two primary windings 14 and 15 come together on the center tap 13. The ends of the primary windings 14 and 15 that are removed from the center tap 13 are connected to ground alternatingly by means of a high-frequency changeover switch 16. The switching frequency of the high-frequency changeover switch 16 determines the frequency with which the series oscillating circuit 7 undergoes excitation, and can be changed. The secondary winding 17 of the transformer 12 feeds the series oscillating circuit 7 at point A. The high-frequency changeover switch 16 is controlled by a control unit 31. The control unit 31 thus predetermines the frequency of the alternating voltage that is generated by the high-frequency generator as secondary voltage and with which the oscillating circuit 7 undergoes excitation.

Such an oscillating circuit 7 comprising an ignition electrode 5 is provided for each combustion chamber of an engine. A high-frequency generator 10 can supply several oscillating circuits 7. However, it is also possible for each oscillating circuit to be connected to its own high-frequency generator 10. In both cases, a single control unit 31 is sufficient.

Figure 2:
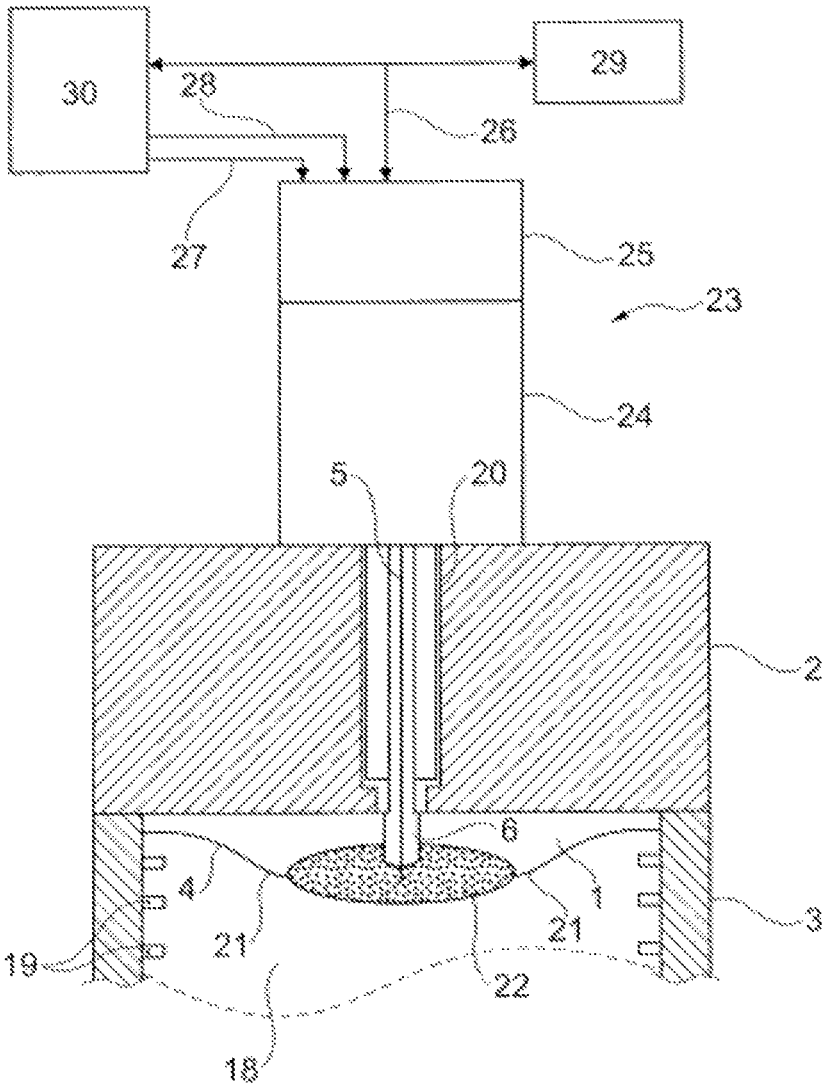
FIG. 2 is a schematic depiction of a longitudinal section through a cylinder of an internal combustion engine having a corona ignition device.

FIG. 2 shows a longitudinal section through a cylinder of an internal combustion engine, which is equipped with the ignition device depicted schematically in FIG. 1. The combustion chamber 1 is bordered by an upper wall 2 that is designed as a cylinder head, by a cylindrical peripheral wall 3 and by the upper side 4 of a piston 18 that moves back and forth in the cylinder, said piston having piston rings 19 added to it.

A passage 20 is located in the cylinder head 2, with which the ignition electrode 5 is electrically insulated and through which it is guided in a sealed manner. The ignition electrode 5 is enclosed by an insulator 6 on part of its length. The insulator 6 may consist of a sintered ceramic material, for example aluminium oxide ceramic. The ignition electrode 5 protrudes into the combustion chamber 1 with its tip and also protrudes somewhat from the insulator 6, but could also end flush with it.

Some sharp-edged protrusions 21 may be provided on the upper side of the piston 18 in the vicinity of the tip of the ignition electrode 5, said protrusions causing a local increase in the electrical field strength between the ignition electrode 5 and the piston 18 that is located opposite it. Predominantly in the area between the ignition electrode 5 and the optionally present protrusions 21 of the piston 18, a corona discharge is formed when the oscillating circuit 7 undergoes excitation, said discharge may be accompanied by a more or less intensive charge carrier cloud 22.

A housing 23 is positioned on the exterior of the cylinder head 2. The primary windings 14 and 15 of the transformer 12 and the high-frequency changeover switch 16 that interacts therewith are located in a first section 24 of the housing 23. The secondary winding 17 of the transformer 12 and the remaining components of the series oscillating circuit 7 and, optionally, means for observing the behaviour of the oscillating circuit 7, are located in a second section 25 of the housing 23. A connection to a diagnostic device 29 and/or to an engine control device 30, for example, is possible via an interface 26.

The control unit 31 sets the frequency anew for each engine cycle. To that end, the control unit calculates a frequency value for the next engine cycle from a current frequency value and the value of a variable, which may be called an adjustment variable in the following. If, for example, the adjustment variable is a flag, this occurs by a predetermined value being added to the current frequency value, wherein the value of the flag specifies the sign of the value. The new frequency value then arises from the current frequency value by a value being added or subtracted according to the value of the adjustment variable. The added or subtracted value may be a constant that has been predetermined in absolute terms in kHz. It is also possible for this value to be dependent on the present frequency value, for example defined as a fraction of the current frequency value.

If the control unit 31 has calculated a new frequency value, the high-frequency generator 10 is activated and controlled in the next engine cycle in such a way that the frequency of the alternating voltage that is then generated by the high-frequency generator 10 corresponds to the new frequency value. For this, in the example shown in FIG. 1, the high-frequency changeover switch 16 is actuated at a frequency whose value concords with the new frequency value.

The value of the adjustment variable is set anew by the control unit 31 in each engine cycle. To that end, the control unit 31 evaluates current voltage, frequency and impedance values, as well as previous voltage, frequency and impedance values.

The primary voltage range that is relevant for the system has been divided into successive intervals, for example 64 intervals or more. A data structure is set up in a storage facility or memory 32 of the control unit 31 for each combustion chamber of the engine, with which a respective impedance value and frequency value are allocated to each of the individual voltage intervals in the form of a table.

An example of such a data structure is depicted schematically in FIG. 3. Here, exactly one impedance value and exactly one frequency value are allocated to each voltage interval. Instead of primary voltage intervals, secondary voltage intervals may also be used.

A present impedance value is determined for each corona discharge and the ignition of fuel that is caused thereby. The impedance value can, for example, be determined as a quotient of primary voltage and primary power or as a quotient of secondary voltage and secondary power. Here, average values of power and voltage or individual measured values can be used at defined points in time during the corona discharge. The maximum value of the impedance that arises during the corona discharge can also be used as the impedance value.

An impedance value and a frequency value are read out from the data structure for the voltage interval in which the present voltage value is located. The read impedance value is then compared to the present impedance value and the read frequency value is compared to the present frequency value.

A value is then assigned to the adjustment variable, which leads to a lower value during a calculation of a frequency value if the present frequency value is higher than the read frequency value and if the present impedance value is higher than the read impedance value, or if the present frequency value is lower than the read frequency value and the new impedance value is lower than the impedance value that was previously stored for this interval. If the adjustment variable is a flag, this is therefore set to be "reduced", e.g. to the value of zero.

If the present frequency value is higher than the read frequency value and the present impedance value is lower than the read impedance value, or if the present frequency value is lower than the read frequency value and the new impedance value is higher than the impedance value previously stored for the relevant voltage interval, then a value is assigned to the adjustment variable, which leads to a higher value during a calculation of a frequency value. If the adjustment variable is a flag, this is therefore set to be "increased", e.g. to the value of one.

If the value of the flag has changed as a consequence of the comparisons, the old value of the flag is overwritten by the currently determined value and a counter is reset. Otherwise the counter status is changed by one and is checked as to whether the counter status has achieved a predetermined end value. If this is the case, the value of the flag in the data structure is changed and the counter status is reset.

Then, in the data structure, the read impedance value is overwritten by the current impedance value and the read frequency value is overwritten by the current frequency value.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE NUMERALS

| | |
|---|---|
| 1. | Combustion chamber |
| 2. | Wall of the combustion chamber |
| 3. | Wall of the combustion chamber |
| 4. | Wall of the combustion chamber, upper side of the piston 18 |
| 5. | Ignition electrode |
| 6. | Insulator |
| 7. | Oscillating circuit, series oscillating circuit |
| 8. | Capacitance |
| 9. | Inductance |
| 10. | High-frequency generator |
| 11. | Direct current voltage source |
| 12. | Transformer |
| 13. | Center tap |
| 14. | Primary winding |
| 15. | Primary winding |
| 16. | High-frequency changeover switch |
| 17. | Secondary winding |
| 18. | Piston |
| 19. | Piston rings |
| 20. | Passage |
| 21. | Protrusions |
| 22. | Charge carrier cloud |
| 23. | Housing |
| 24. | First section of 23 |
| 25. | Second section of 23 |
| 26. | Interface |
| 27. | Input |
| 28. | Input |
| 29. | Diagnostic device |
| 30. | Engine control device |
| 31. | Control device |
| 32. | Memory |

What is claimed is:

1. A corona ignition system for igniting fuel in a combustion chamber of a cyclically operating internal combustion engine, comprising:

an oscillating circuit comprising an ignition electrode;

a high-frequency generator configured for generating an alternating voltage from a primary voltage in order to excite the oscillating circuit; and a control unit configured for controlling the high-frequency generator, the control unit having a memory in which a data structure is provided, the data structure allocating an impedance value and a frequency value to successive intervals of voltage values, wherein the control unit is configured to:

determine an impedance value, a frequency value and a corresponding voltage value for each ignition, store the impedance and frequency values in the data structure and allocate the impedance and frequency values to the interval in which the corresponding voltage value is located;

store a variable in the memory and use the variable to calculate a frequency value and set a frequency of the alternating voltage to the frequency value before a corona discharge is generated; and each time new frequency and impedance values are allocated to one of the intervals and stored in the data structure, define the value of the variable anew by assigning to the variable a value that effects the setting of the frequency of the alternating voltage as follows:

to a lower value than the new frequency value if (i) the new frequency value is higher than the frequency value stored previously for this interval and if the new impedance value is higher than the impedance value stored previously for this interval, or (ii) the new frequency value is lower than the frequency value that was previously stored for this interval and the new impedance value is lower than the impedance value that was previously stored for this interval; and to a higher value than the new frequency value if (i) the new frequency value is higher than the frequency value that was previously stored for this interval and if the new impedance value is lower than the impedance value that was previously stored for this interval, or (ii) the new frequency value is lower than the frequency value that was previously stored for this interval and the new impedance value is higher than the impedance value that was previously stored for this interval.

2. The corona ignition system according to claim 1, wherein the successive intervals of voltage values are intervals of primary voltage values.

3. The corona ignition system according to claim 1, wherein the variable is a flag.

4. The corona ignition system according to claim 1, wherein, after the engine has started, the frequency of the alternating voltage is calculated by the control unit for each ignition from the variable and the frequency value used during the previous ignition.

5. The corona ignition system according to claim 4, wherein the frequency of the alternating voltage is calculated by adding an amount to the frequency value, wherein the variable defines the sign of the amount.

6. The corona ignition system according to claim 5, wherein the amount is independent of the frequency value.

7. The corona ignition system according to claim 1, further comprising a counter that is reset by the control unit when the variable is changed from a value that effects an increase in frequency to a value that effects a reduction in frequency, or when the variable is changed from a value that effects a reduction in frequency to a value that effects an increase in frequency, wherein the control unit changes the counter status by one when the value assigned to the variable and the stored value of the variable effect an increase in the frequency or when the value assigned to the variable and the stored value of the variable effect a reduction in the frequency.

8. The corona ignition device of claim 7, wherein each time a value is to be assigned to the variable, the control unit checks whether the counter status has achieved a predetermined end value, and, if this is the case, resets the counter and changes the variable from a value that effects an increase in frequency to a value that effects a reduction in frequency, or from a value that effects a reduction in frequency to a value that effects an increase in frequency.

9. The corona ignition system according to claim 1, wherein in that the data structure provides at least 64 voltage intervals.

10. A method for controlling a corona ignition device, said device comprising a high-frequency generator and an oscillating circuit, said oscillating circuit comprising an ignition electrode, the method comprising:

feeding a primary voltage into the high-frequency generator to thereby generate an alternating voltage;

using the alternating voltage to excite the oscillating circuit and thereby generating a corona discharge on the ignition electrode, said corona discharge causing an ignition of fuel in a combustion chamber of an engine;

determining an impedance value, a voltage value and a frequency value for the current engine cycle;

reading frequency and impedance values from a data structure in which an impedance value and a frequency value are allocated to each of successive voltage intervals;

wherein the read frequency and impedance values are allocated in the data structure to the respective voltage interval that contains the voltage value of the current engine cycle;

the impedance value and the frequency value of the current engine cycle are compared to the read impedance value and the read frequency value;

the frequency of the alternating voltage is increased for the next engine cycle if (i) the current frequency value is greater than the read, previous frequency value and if the current impedance value is smaller than the read, previous impedance value, or (ii) the current frequency value is smaller than the read, previous frequency value and if the current impedance value is greater than the read, previous impedance value;

the frequency of the alternating voltage is reduced for the next engine cycle if (i) the current frequency value is greater than the read, previous frequency value and the current impedance value is greater than the read, previous impedance value, or (ii) the current frequency value is smaller than the read, previous frequency value and the current impedance value is smaller than the read, previous impedance value.

11. The method according to claim 10, wherein the frequency is always changed from one engine cycle to the next.

* * * * *